United States Patent [19]

Sipp et al.

[11] 4,125,313

[45] Nov. 14, 1978

[54] ELECTRICAL CONNECTION DEVICE

[75] Inventors: Steven O. Sipp, Painesville; Gary M. Schmidt, Cleveland; John T. Venaleck, Painesville, all of Ohio

[73] Assignee: A P Products Incorporated, Painesville, Ohio

[21] Appl. No.: 845,228

[22] Filed: Oct. 25, 1977

Related U.S. Application Data

[63] Continuation of Ser. No. 653,476, Jan. 29, 1976, abandoned.

[51] Int. Cl.[2] ..... H01R 13/02

[52] U.S. Cl. ..... 339/176 M; 339/218 M; 339/258 P

[58] Field of Search ..... 339/65, 176, 198, 218, 339/258

[56] References Cited

U.S. PATENT DOCUMENTS

| | | | |
|---|---|---|---|
| 3,193,787 | 7/1965 | McGhee | 339/176 MP |
| 3,270,311 | 8/1966 | Deer et al. | 339/176 MP |
| 3,560,295 | 3/1970 | Faber et al. | 339/218 M |
| 3,596,235 | 7/1971 | Teurlings et al. | 339/176 MP |

FOREIGN PATENT DOCUMENTS

| | | | |
|---|---|---|---|
| 1,283,664 | 12/1961 | France | 339/198 S |
| 454,244 | 6/1968 | Switzerland | 339/198 S |

*Primary Examiner*—Joseph H. McGlynn
*Attorney, Agent, or Firm*—Maky, Renner, Otto & Boisselle

[57] ABSTRACT

An electrical connection device provides an on-line extension of a multi-conductor electrical cable assembly permitting electrical entry of the cable circuits while they are operational, facilitates interconnection of plural multi-conductor electrical cable assemblies, enables hands-off probing of respective circuits of such assemblies, allows facile field modification of electrical equipment utilizing such assemblies, and the like.

5 Claims, 4 Drawing Figures

ELECTRICAL CONNECTION DEVICE

This is a continuation, of application Ser. No. 653,476, filed Jan. 29, 1976, now abandoned.

BACKGROUND OF THE INVENTION

The present invention relates, in general, to an electrical connection device and, in particular, to such a connection device that effects simultaneous connection of respective circuits of a multi-conductor electrical cable assembly with a like assembly of the same or opposite sex type, of such an assembly with a multiple contact terminal, and the like.

Multi-conductor electrical cables are used to connect plural electrical signals between two locations, such as, for example, between two sub-assemblies of a computer or the like. Such multi-conductor electrical cables include more than two individual conductors therein and often may include on the order of from about twenty to about fifty or even more individual conductors for conducting a corresponding number of electrical signals. One type of multi-conductor electrical cable commonly used in the computer industry is a flat or ribbon-like cable. To facilitate simultaneous connection of the multiple conductors in such a cable to those of another cable, to a multiple contact terminal of a computer, or other such device, various types of available terminations are used. These terminations include a plurality of electrical contacts, such as fork contacts, pin contacts, respectively being of the female or male type, or other contacts, of a number corresponding to the number of conductors in the cable. The combination of such a multi-conductor electrical cable and a termination therefor constitutes a multi-conductor cable assembly, sometimes referred to below as a cable assembly, cable termination assembly and the like.

SUMMARY OF THE INVENTION

In the present invention an on-line electrical connection device provides an extension for such multi-conductor cable assemblies to interconnect two or more such assemblies in electrical series or electrical parallel relation, to connect one or more such assemblies with a multiple contact terminal, for example, of a computer, to facilitate connecting the circuits of such assemblies to external devices for testing or exercising purposes, to facilitate field modification of circuits employing such assemblies, and so on.

The on-line feature of the present invention means that it is connectible physically as an extension of a multi-conductor cable assembly between the latter and, for example, another assembly or other terminal, as opposed to being a remotely located connector or piece of electrical equipment, and this feature facilitates making of the described connections without having to proceed through a relatively remotely located device, thereby reducing circuit materials and enhancing the integrity of the made electrical connections. In the following description reference to circuits, circuit portions, conductor circuits, etc., means an electrically conductive path, whether a wire conductor, a contact conductor or the like, forming either part of a complete electrical circuit or potentially useful as part of an electrical circuit.

Accordingly, the electrical connection device of the invention permits electrically entering each of the conductor circuits of a multi-conductor cable assembly while the latter is connected for and in operational use. Such electrical entry enables immediate testing, measuring, exercising, modifying, etc., of those circuits without interrupting operation. Reference here to exercising means the input of supplemental signals from an external supply via the connection device to determine the responsive reaction of the circuits being exercised. Moreover, while the connection device is so operationally connected on-line with one or more cable assemblies respective accessible contacting parts are provided for the mechanical attachment of a test probe tip or the like for testing or other purposes of each circuit in a hands-off manner, whereby the technician's hands are free for operating the test equipment, whereby the test equipment can continuously monitor the circuits, etc. Further, two or more such cable assemblies with terminations of the same sex type may be interconnected, which may reduce the usual cable assembly inventory normally stocked by manufacturers, distributors, etc. Additionally, two or more of the connection devices may be connected together as a modular parallel bus system, for example, to join signals from several circuit boards or the like.

With the foregoing in mind, it is a primary object of the invention to provide a usable, readily accessible on-line terminal for each of the conductor circuits of a multi-conductor cable assembly.

Another object is to extend the respective contacts of a multi-conductor cable termination to provide an additional contact part for each respective contact of such termination.

An additional object is to provide for hands-off probing of plural circuits running through a multi-conductor electrical connector, cable assembly and the like.

A further object is to connect plural multi-conductor cable terminations of the same sex type.

Still another object is to connect two multi-conductor cable assemblies in electrical parallel.

Still an additional object is to facilitate on-line testing and/or exercising of plural circuits including the respective conductors of a multi-conductor cable assembly.

Still a further object is to provide on-line input electrical signals to the respective conductors of a multi-conductor cable assembly.

Yet another object is to divide each of the conductor circuits of a multi-conductor cable assembly to respective plural circuits.

Yet an additional object is to provide each of the foregoing features for a multi-conductor cable assembly having on the order of from about 20 to about 50 individual conductors.

These and other objects and advantages of the present invention will become more apparent as the following description proceeds.

To the accomplishment of the foregoing and related end, the invention, then, comprises the features hereinafter fully described in the specification and particularly pointed out in the claims, the following description and the annexed drawing setting forth in detail a certain illustrative embodiment of the invention, this being indicative, however, of but one of the various ways in which the principles of the invention may be employed.

DESCRIPTION OF THE PREFERRED EMBODIMENT

Figure 1:
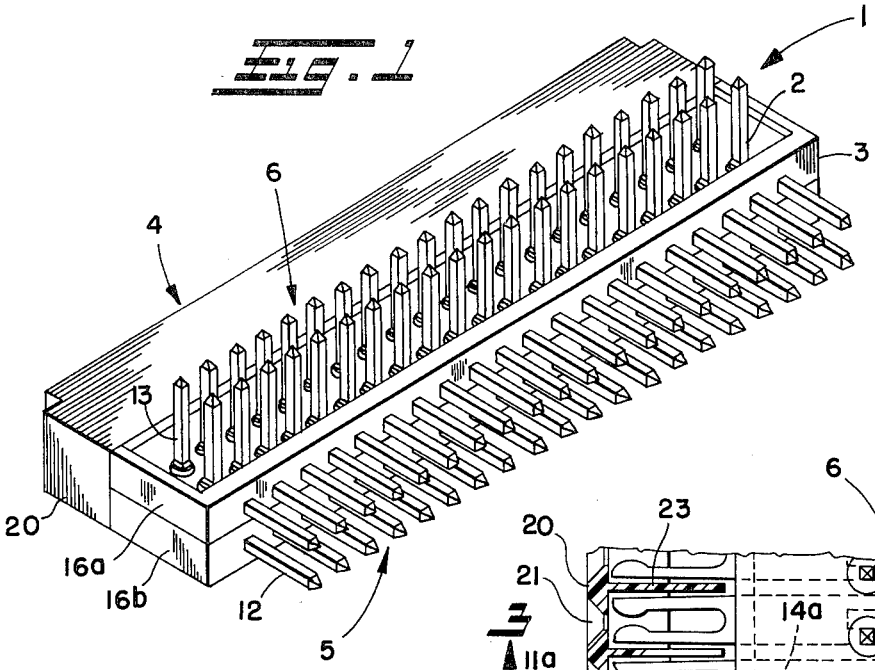
FIG. 1 is an isometric view of the connection device of the invention.

Turning now more particularly to the drawing, wherein like reference numerals designate like parts in the several figures, the electrical connection device in accordance with the invention is generally indicated at 1 in FIG. 1. The fundamental parts of the electrical connection device 1 comprise a plurality of electrical contacts 2, for example, of suitable electrically conductive material held in relatively fixed positions by a dielectric, i.e., electrically non-conductive, housing 3, for example, of plastic-like material. The connection device 1 may have, for example, first, second and third connecting portions 4, 5, 6 at the front, back and top thereof, respectively, formed by respective contacting parts of the electrical contacts 2 in respective conventional dual-in-line patterns ready for connection with appropriate contacts of a dual-in-line configured multi-conductor cable termination, multiple contact terminal and the like.

Figure 2:
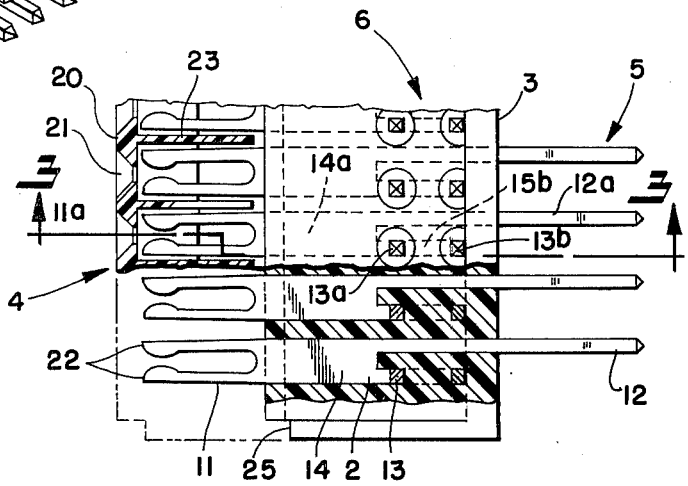
FIG. 2 is a partial top plan view, partially broken away in section, of the connection device of FIG. 1, having part of the housing cover removed.
Figure 3:
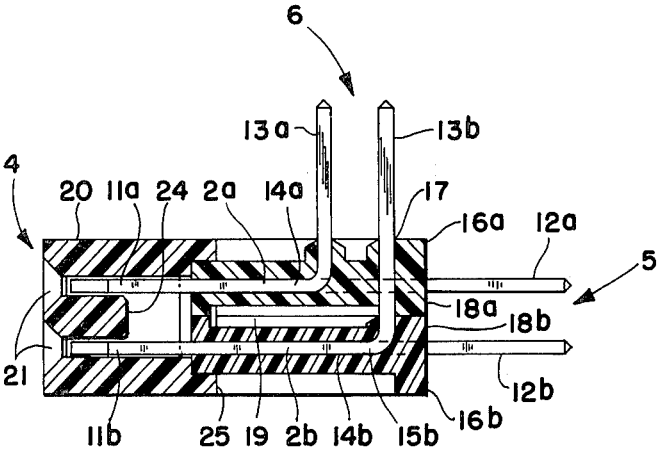
FIG. 3 is a section view of the connection device with the housing cover in place and looking generally in the direction of the arrows 3—3 of FIG. 2.
Figure 4:
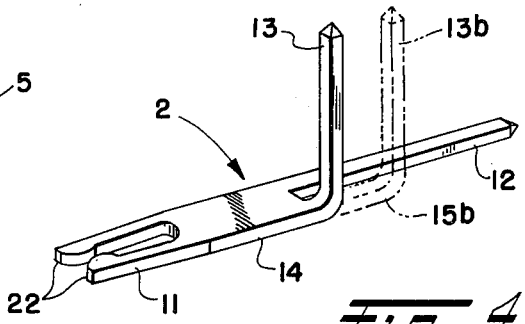
FIG. 4 is an isometric view of a typical electrical contact utilized in the connection device.

Reference to contacting parts herein means those portions of the electrical contacts 2 adapted for electrical and at least abutting mechanical connection with part of another electrical contact; for example, in the illustrated embodiment of the invention a first contacting part 11 of each electrical contact 2 is a female type fork contact and second and third parts 12, 13 are male type pin contacts, as is shown more clearly in FIGS. 2, 3 and 4. The first connecting portion 4, therefore, is comprised of all the first contacting parts 11 and is intended for connection with a corresponding pattern of pin contacts of a male termination or the like, and the second and third connecting portions comprise, respectively, the second and third contacting parts 12, 13 for connection, for example, with female terminations or the like, for test probing, etc. Moreover, each of the contacting parts 11, 12, 13 has a readily accessible portion for making such connections and the pin contacts 12, 13 additionally may be grasped by the jaws of a test probe or conveniently touched to abutment thereby for hands-off testing purposes, as described.

Referring now more particularly to FIGS. 2, 3, and 4, each electrical contact 2 comprises a base 14 from which the first, second and third contacting parts 11, 12, 13 are commonly supported, and preferably the first and second contacting parts of each electrical contact are substantially co-planar with the base 14 and extend therefrom generally in parallel, but opposite, directions, respectively, toward the front and rear of the electrical connection device. On the other hand, the third contacting part 13 of each electrical contact extends in an upward direction generally perpendicular to the directional extents of the first and second contacting parts 11, 12.

As is illustrated most clearly in FIG. 3, the electrical contacts 2 are positioned in two spaced apart parallel rows, the upper row being represented by the electrical contact **2*a*, and the lower row being represented by the electrical contact 2*b*, these having respective parts designated by a corresponding suffix. By so positioning the electrical contacts 2*a* and 2*b* in such parallel rows, the dual-in-line positioning of the first contacting parts 11*a*, 11*b* in the first connecting portion 4 and the second contacting parts 12*a*, 12*b* in the second connecting portion 5, the dual-in-line patterns of those connecting portions are readily achieved. Moreover, to obtain the dual-in-line pattern of the third contacting parts 13*a*, 13*b* in the third connecting portion 6, each of the third contacting parts 13*b* of the electrical contacts 2*b* is offset from its base 14*b* by an extension 15*b*, which is defined between the base and the location of the upward extent or bend of the third contacting part 13*b*; whereas the third contacting parts 13*a* of the electrical contacts 2*a* commence their vertical extent relatively more proximate their respective bases 14*a***.

The electrical contacts 2 may be stamped from flat metal stock or sheet material, and after being stamped the leg of the third contacting part may be bent perpendicularly to the otherwise generally flat planar extent of the electrical contact. When the leg is bent close to the base, the third contacting part **13*a* is formed; and when the leg is bent more remotely from the base, the off-setting extension 15*b* and third contacting part 13*b*** are formed.

The dielectric housing 3 is formed of upper and lower body parts **16*a*, 16*b* preferably molded, respectively, about at least part of the electrical contacts 2*a*, 2*b*. Openings 17 in the upper body part 16*a* provide passage therethrough for the third contacting parts 13*b* for their alignment with the respective third contacting parts 13*a* in the dual-in-line pattern of the third connecting portion 6. The upper body part 16*a* has a bottom peripheral flange 18*a* for abutment and securing with a top peripheral flange 18*b* on the lower body part 16*b*, for example, by ultrasonic welding or other fastening technique, with the third contacting parts 13*b* positioned through the respective openings 17. A hollow 19** is defined between the thusly secured body parts facilitating their assembly.

A housing cover 20 may be included as another part of the dielectric housing 3 for guiding pin contacts, for example, through respective openings 21 in the cover to engagement with respective pairs of fork-like arms 22 of the fork contacts comprising the first contacting parts of the electrical contacts 2. The housing cover 20 also has interior walls 23, 24 for further guidance of inserted pins and for electrical isolation of respective fork contacts, and the housing cover may be secured to the housing body parts **16*a*, 16*b* at a step juncture 25**, for example, by ultrasonic welding or other fastening technique.

In one exemplary use of the electrical connection device 1, it may be connected on-line as an extension of a multi-conductor cable assembly between the latter and a terminal input of an electrical apparatus, such as a computer, utilizing the first and second connecting portions 4, 5. The third contacting parts 13 are then readily accessible for electrically entering each of the circuits connected through the device 1, for example, by one or more individual test probes that may be touched or secured to respective third contacting parts 13 to examine or to test signals in the respective circuits. Alternatively, another multi-conductor cable assembly may be attached to the third connecting portion 6 to connect the same to remotely located electrical equipment for comprehensive electrical testing and/or exercising of the respective circuits. As another alternative the device 1 may join two multi-conductor cable assemblies in parallel with each other by connection to two of the connecting portions thereof and in series with such electrical apparatus by connection of the remaining connecting portion to such apparatus. Similarly, by connecting together two electrical connection devices 1 as a modular parallel bus system, three cable assemblies may be connected in parallel with each other and in series with such electrical apparatus, and so on. The device 1 allows connection of two cable assemblies of the same sex type, e.g., two terminations both employing fork contacts, and facilitates field modification of electrical equipment employing such cable assemblies, for example, by the addition of circuits, short circuiting of existing circuits, etc. These are but a few of the various uses of electrical connection device 1.

It will, of course, be appreciated that the respective contacting parts of the electrical connection device 1 may be all male type, all female type, all another type, or any combination thereof in accordance with the invention. Also, while the preferred form of the device 1 provides the contacting parts in dual-in-line patterns, they may be in a single-line pattern or in a three or more in-line pattern in accordance with the invention. Further, it will be appreciated that each electrical contact of the device 1 may be formed of four respective contacting parts, for example, by pins bent vertically downward relative to the illustration of FIG. 3 with those of the contacts 2*a* being off-set from their bases. Moreover, the directional extents, vis-a-vis the coplanar and perpendicular directions, of the contacting parts may be modified while still being within the spirit and scope of the invention.

It should now be clear that the present invention provides for the extension of a multi-conductor cable assembly having several or many conductor circuits therein, thereby to increase the versatility of such cable asembly and the circuits in which the conductors thereof are connected.

The embodiments of the invention in which an exclusive property or privilege is claimed are defined as follows:

1. An on-line electrical connector for simultaneously electrically connecting a first plurality of electrical circuits that terminate at respective electrical contacts of at least one multi-conductor electrical cable termination, cable termination assembly, or like device to respective ones of a second plurality of electrical circuits of another such device, comprising a plurality of electrical contact means connectable to the respective electrical contacts for simultaneously electrically connecting the first plurality of electrical circuits to respective ones of the second plurality of electrical circuits, each electrical contact means including a base, first female contact means, a second male contact, and a third male contact as respective contacting parts configured and relatively accessibly positioned for mechanical and electrical connection with respective electrical contacts of such respective devices, or the like, and a dielectric housing comprised of a body of dielectric material molded directly to and in surrounding engagement with at least part of each respective base of said plurality of electrical contact means to secure said electrical contact means in relatively fixed, electrically isolated positions with at least a portion of each of said contacting parts being exposed from said body for such electrical connection, said body being the sole means of relative support for said electrical contact means and forming an integral structure therewith, said first female contact means and said second male contact of each electrical contact means being coplanar and extending in generally parallel, opposite directions from said base, said third male contact of each electrical contact means extending primarily in a perpendicular direction to the coplanar extent of said first female contact means and said second male contact, all of said first female contact means, second male contacts, and third male contacts, respectively, of said electrical contact means being positioned to extend in respective generally parallel directions, said electrical contact means being positioned with their respective bases in one of first and second parallel rows, and said first female contact means, said second male contacts, and said third male contacts also being positioned in respective pairs of parallel rows in dual-in-line configuration to form, respectively, first, second, and third connecting portions, said second parallel row of electrical contact means being located in said body more remote from the accessible portion of said third male contacts than said first parallel row of electrical contact means, each of said electrical contact means in said second parallel row further comprising extension means for connecting said third male contact thereof with said base relatively off-set from the third male contact of said electrical contact means in said first parallel row, said body comprising a plurality of bodies, a first one of said bodies being molded directly to and in direct engagement with at least part of each respective base of said electrical contact means in said first parallel row and a second one of said bodies being molded directly to and in direct engagement with at least part of each respective base of said electrical contact means in said second parallel row, said first one of said bodies including passage means for passing therethrough said third male contacts of said electrical contact means in said second parallel row for exposure in parallel juxtaposition with said third male contacts of said electrical contact means in said first parallel row to provide such dual-in-line accessible positioning of all of said third male contacts, and said dielectric housing further including a separate cover means secured to said body for guiding male contacts of such a device to engagement with said respective female contact means.

2. The connector of claim 1, wherein each of said female contact means comprises a fork-like contact means and each of said second and third male contacts comprises a pin contact.

3. An on-line electrical connector for simultaneously electrically connecting a plurality of electrical circuits terminating at contacts or the like of at least one multi-conductor electrical cable termination assembly or the like device to a plurality of electrical circuits, respectively, of at least another such device, comprising a plurality of electrical contact means for connecting the plurality of electrical circuits terminating in one such device to the respective electrical circuits terminating in another such device, each electrical contact means including a base and first, second, and third contacting parts, said first contacting part comprising a female contact means for connecting with a male contact inserted to engagement therwith, and said second and third contacting parts comprising respective male contacts, said female contact means and said male contact of said second contacting part being coplanar and extending in generally parallel opposite directions, and said male contact of said third contacting part primarily extending in a direction perpendicular to such coplanar extent and to said generally parallel, opposite directions, and a dielectric housing means molded to said electrical contact means for supporting the same in relative fixed, electrically isolated position with at least a portion of each of said contacting parts being exposed and accessibly positioned for electrical connection to respective external devices; wherein for each of said electrical contact means said base is coplanar with said female contact means and said male contact of said second contacting part, each of said male contacts comprises spaced-apart prong-like extensions of said base one of which is bent perpendicularly with respect to the coplanar extent of said base, female contact means and other prong-like extension to form said male contact of said third contacting part; and wherein said housing comprises first and second bodies of dielectric material molded directly to and in surrounding engagement with at least part of each respective bases of respective pluralities of electrical contact means to secure the same in relative fixed, electrically isolated positions and forming respective integral structures therewith, one of said bodies including passage means for passing therethrough said third contacting parts of said electrical contact means in the other of said bodies for exposure of such passed third contacting parts in parallel juxtaposition with said third contacting parts of said electrical contact means in said one of said bodies.

4. The connector of claim 3, wherein said bodies are secured together as a unitary structure with said first, second and third contacting parts extending in respective dual-in-line patterns, and wherein said housing further comprises a cover means secured to said bodies for guiding male contacts of such a device to engagement with said respective female contact means.

5. The connector of claim 3, wherein each of said female contact means comprises a fork-like contact means and each of said male contacts comprises a pin contact.

* * * * *